US008271120B2

(12) United States Patent
Menapace et al.

(10) Patent No.: US 8,271,120 B2
(45) Date of Patent: Sep. 18, 2012

(54) METHOD AND SYSTEM FOR PROCESSING OPTICAL ELEMENTS USING MAGNETORHEOLOGICAL FINISHING

(75) Inventors: Joseph Arthur Menapace, Livermore, CA (US); Kathleen Irene Schaffers, Livermore, CA (US); Andrew James Bayramian, Manteca, CA (US); William A. Molander, Livermore, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 360 days.

(21) Appl. No.: 12/760,418

(22) Filed: Apr. 14, 2010

(65) Prior Publication Data

US 2011/0028071 A1 Feb. 3, 2011

Related U.S. Application Data

(60) Provisional application No. 61/230,793, filed on Aug. 3, 2009.

(51) Int. Cl.
*G06F 19/00* (2006.01)
*B24B 1/00* (2006.01)

(52) U.S. Cl. ..... 700/117; 700/164; 451/42

(58) Field of Classification Search ..... 700/117, 700/164; 451/5, 42
See application file for complete search history.

(56) References Cited

U.S. PATENT DOCUMENTS 3,748,015 A 7/1973 Offner
5,180,150 A * 1/1993 Prusak et al. ..... 269/254 R
6,746,310 B2 6/2004 Tricard et al.
6,819,438 B2 11/2004 Neily et al.
6,922,599 B2 7/2005 Richey
2002/0081943 A1 6/2002 Hendron et al.
2010/0125356 A1 * 5/2010 Shkolnik et al. ..... 700/98

OTHER PUBLICATIONS

International Search Report and Written Opinion of PCT Application No. PCT/US2010/044138, mailed Oct. 1, 2010, 8 pages total.

Bagnoud et al., Laboratory for Laser Energetics, "High-Energy, High-Average-Power Laser Using Nd:YLF Rods Corrected by Magnetorheological Finishing," LLE Review 99, Apr.-Jun. 2004, 9 pages total. Retrieved from the Internet: <http://www.lle.rochester.edu/pub/review/V99/99High04-C.pdf>.

Bagnoud et al., "High-Energy, High-Average-Power Laser Using Nd:YLF Rods Corrected by Magnetorheological Finishing," Jan. 10, 2005; Applied Optics, 44(2): 282-288.

(Continued)

*Primary Examiner* — Ryan Jarrett
(74) *Attorney, Agent, or Firm* — Kilpatrick, Townsend & Stockton

(57) ABSTRACT

A method of finishing an optical element includes mounting the optical element in an optical mount having a plurality of fiducials overlapping with the optical element and obtaining a first metrology map for the optical element and the plurality of fiducials. The method also includes obtaining a second metrology map for the optical element without the plurality of fiducials, forming a difference map between the first metrology map and the second metrology map, and aligning the first metrology map and the second metrology map. The method further includes placing mathematical fiducials onto the second metrology map using the difference map to form a third metrology map and associating the third metrology map to the optical element. Moreover, the method includes mounting the optical element in the fixture in an MRF tool, positioning the optical element in the fixture; removing the plurality of fiducials, and finishing the optical element.

18 Claims, 12 Drawing Sheets

OTHER PUBLICATIONS

Menapace et al., "Combined Advanced Finishing and UV-Laser Conditioning for. Producing UV-Damage-Resistant Fused Silica Optics," Proc. SPIE, Laser-Induced Damage in Optical Materials, Nov. 2001; 4679: 56-68. Retrieved from the Internet: <http://www.zygo.com/library/papers/proc_4679_56.pdf>.

Wegner et al., "NIF Final Optics System: Frequency Conversion and Beam Conditioning," Optical Engineering at the Lawrence Livermore National Laboratory II: The National Ignition Facility. Edited by Lane, Monya A.; Wuest, Craig R. Proceedings of the SPIE, 2004; 5341: 180-189. Retrieved from the Internet: <https://lasers.llnl.gov/programs/pdfs/final_optics_system.pdf>.

Menapace et al., "Magnetorheological Finishing for Imprinting Continuous Phase Plate Structure onto Optical Surfaces" in Boulder Damage Symposium XXXV, Boulder, CO (US), Sep. 21-24, 2003, 13 pages total.

Menapace et al., "MRF applications : Measurement of process-dependent subsurface damage in optical materials using the MRF wedge technique," in Boulder Damage Symposium, Boulder, CO (US), Sep. 19-21, 2005, 11 pages total.

Menapace et al., "MRF Applications: On the Road to Making Large-Aperture Ultraviolet Laser Resistant Continuous Phase Plates for High-Power Lasers," in Boulder Damage Symposium, Boulder, CO (US), Sep. 25-27, 2006, 13 pages total.

Menapace et al., "Utilization of Magnetorheological Finishing as a Diagnostic Tool for Investigating the Three•Dimensional Structure of Fractures in Fused Silica," in Boulder Damage Symposium XXXII, Boulder, CO (US), Sep. 19-21, 2005, 14 pages total.

Molander, "A Large-Bandwidth, Cylindrical Offner Pulse Stretcher for a High-Average-Power, 15 Femtosecond Laser", in Advanced Solid-State Photonics Conference, Denver, Colorado, Feb. 1-4, 2009, 3 pages total.

Schaffers et al., "Improved Optical Quality for Ti:Sapphire Using MRF," in Advanced Solid-State Photonics, Nara, Japan, Jan. 27, 2008, 2 pages total.

Weiner, "Femtosecond Pulse Shaping Using Spatial Light Modulators," Rev. Sci. Instrum., May 2000; 71(5):1929-1960.

U.S. Appl. No. 12/782,566, filed May 18, 2010; first named inventor: Andrew James Bayramian.

* cited by examiner

After long wavelength MRF correction

RMS = 0.008 μm
P-V = 0.091 μm ≅ λ/11.5

Before MRF polishing

RMS = 0.030 μm
P-V = 0.179 μm ≅ λ/6

Before short wavelength MRF correction

RMS = 0.008 μm
P-V = 0.091 μm ≅ λ/11.5

After short wavelength MRF correction

RMS = 0.009 μm
P-V = 0.047 μm ≅ λ/22.3

METHOD AND SYSTEM FOR PROCESSING OPTICAL ELEMENTS USING MAGNETORHEOLOGICAL FINISHING

CROSS-REFERENCES TO RELATED APPLICATIONS

This application claims priority to U.S. Provisional Patent Application No. 61/230,793, filed on Aug. 3, 2009, entitled "Improved optical quality for titanium doped sapphire and sapphire through magnetorheological finishing," the disclosure of which is hereby incorporated by reference in its entirety for all purposes.

STATEMENT AS TO RIGHTS TO INVENTIONS MADE UNDER FEDERALLY SPONSORED RESEARCH OR DEVELOPMENT

The United States Government has rights in this invention pursuant to Contract No. DE-AC52-07NA27344 between the U.S. Department of Energy and Lawrence Livermore National Security, LLC, for the operation of Lawrence Livermore National Laboratory.

BACKGROUND OF THE INVENTION

Processes for polishing optical elements have been developed for many years. A typical finishing process for an optical lens includes removing material at the surface of the lens to smooth the surface and impart the desired figure, for example, curvature.

Magnetorheological finishing (MRF) is a deterministic surface finishing technique based on a sub-aperture polishing tool. MRF has been applied to the polishing and finishing of optical elements. The technique uses a magnetorheological (MR) fluid with a viscosity that is a function of the magnetic field applied to the MR fluid. As an example, iron carbonyl is used in some MR fluids and has a viscosity that can be increased by up to a factor of ~1000 by application of a magnetic field.

The MR fluid is delivered by a fluid pump to a rotating spherical wheel as a ribbon adjacent to the moving optical element. An electromagnet generates a field at the face of the optical element that causes the MR fluid to stiffen, thus becoming a sub-aperture polishing tool. The MRF system provides control over the shape and stiffness of the MR fluid used to polish the workpiece. When the stiffened fluid on the rotating wheel moves out of the magnetic field, it reverts to a lower viscosity liquid and is captured by a fluid drain and recycled. Typically, the removal rate of the MRF polishing tool is maintained at a constant level by monitoring system parameters including the flow rate of the MR fluid, the pressure within the delivery system, the temperature of the MR fluid, and the like.

The shear stress at the MR fluid/optical element interface is used to polish the optical element and the stiffened MR fluid can be analyzed in terms of a removal function. The material removal rate is controlled by varying the residence time over the optical surface.

Rotational polishing can be performed by moving the removal function across the part along a radius-theta path. The radius and the rotational speed (determining the angular velocity) are adjusted to provide the desired figure control. Raster polishing can be performed by moving the removal function across the optical element along a raster scan path. The raster speed is adjusted (determining the linear velocity) to provide the desired figure control.

Despite the benefits provided by conventional MRF polishing tools, there is a need in the art for improved methods and systems for polishing optical elements using MRF systems.

SUMMARY OF THE INVENTION

According to the present invention, techniques related to optical systems are provided. More particularly, embodiments of the present invention relate to methods and systems for polishing and/or finishing optical elements utilizing a magnetorheological finishing (MRF) process. Merely by way of example, the invention is applied to compensation of internal optical variations in an optical element by imprinting smooth topographical features on one or more surfaces of the optical element. The methods and systems described herein are also applicable to processing and finishing of other optical systems.

According to an embodiment of the present invention, a method of finishing an optical element is provided. The method includes mounting the optical element in an optical mount having a plurality of fiducials overlapping with the optical element, obtaining a first metrology map for the optical element and the plurality of fiducials, and obtaining a second metrology map for the optical element without the plurality of fiducials. The method also includes forming a difference map between the first metrology map and the second metrology map and aligning the first metrology map and the second metrology map. The method further includes placing mathematical fiducials onto the second metrology map using the difference map to form a third metrology map and associating the third metrology map to the optical element. Moreover, the method includes mounting the optical element in the fixture in an MRF tool, positioning the optical element in the fixture, removing the plurality of fiducials, and finishing the optical element.

According to another embodiment of the present invention, an MRF system for polishing an optical element is provided. The MRF system includes a processor and an MRF tool coupled to the processor. The MRF tool includes a wheel operable to provide a predetermined removal function and an optical mount operable to receive the optical element and a plurality of fiducial. The MRF system also includes a computer readable medium coupled to the processor and storing a plurality of instructions for controlling the MRF tool to polish the optical element. The plurality of instructions include instructions that cause the data processor to obtain a first metrology map for the optical element and the plurality of fiducials, instructions that cause the data processor to obtain a second metrology map for the optical element without the plurality of fiducials, and instructions that cause the data processor to form a difference map between the first metrology map and the second metrology map. The plurality of instructions also include instructions that cause the data processor to align the first metrology map and the second metrology map and instructions that cause the data processor to place mathematical fiducials onto the second metrology map using the difference map to form a third metrology map. The plurality of instructions further include instructions that cause the data processor to associate the third metrology map to the optical element and instructions that cause the data processor to control the MRF tool to finish the optical element.

According to a specific embodiment of the present invention, a method for polishing an optical element is provided. The method includes mounting the optical element in an optical mount having an area operable to receive the optical element and a plurality of fiducials positioned adjacent to the area, obtaining a first metrology map including the optical element and the plurality of fiducials, obtaining a second metrology map including the optical element, the second metrology map being free of the plurality of fiducials, and forming a difference metrology map based on the first metrology map and the second metrology map. The method also includes aligning the first metrology map to the second metrology map and adding mathematical fiducials to the second metrology map to form a third metrology map. The method further includes positioning the optical mount in an MRF tool, registering the optical mount to the MRF tool using the third metrology map, and polishing the optical element.

According to another specific embodiment of the present invention, an MRF system for polishing an optical element is provided. The MRF system includes a processor, an optical imaging system, and an MRF tool coupled to the processor. The MRF tool includes a wheel operable to provide a predetermined removal function and an optical mount operable to receive the optical element and including a plurality of external fiducials. The MRF system also includes a computer readable medium coupled to the processor and storing a plurality of instructions for controlling the MRF tool to polish the optical element. The plurality of instructions include instructions that cause the data processor to mounting the optical element in an optical mount having an area operable to receive the optical element and a plurality of fiducials positioned adjacent to the area. The plurality of instructions also include instructions that cause the data processor to obtain a first metrology map including the optical element and the plurality of fiducials, instructions that cause the data processor to obtain a second metrology map including the optical element, the second metrology map being free of the plurality of fiducials, and instructions that cause the data processor to form a difference metrology map based on the first metrology map and the second metrology map. The plurality of instructions further include instructions that cause the data processor to align the first metrology map to the second metrology map, instructions that cause the data processor to add mathematical fiducials to the second metrology map to form a third metrology map, and instructions that cause the data processor to control the MRF tool to polish the optical element.

Numerous benefits are achieved by way of the present invention over conventional techniques. For example, the present technique provides a method to compensate for internal optical variations in optical elements, thereby improving system performance for lasers and amplifiers utilizing the optical elements. Additionally, utilizing embodiments of the present invention, manufacturers are able to reprocess finished optics, which may fail to meet performance requirements, improving manufacturing yield. Moreover, embodiments of the present invention enable material that is initially deemed to be inferior in quality to be processed to specifications exceeding the initial specifications. Depending upon the embodiment, one or more of these benefits may be achieved. These and other benefits will be described in more detail throughout the present specification and more particularly below.

These and other objects and features of the present invention and the manner of obtaining them will become apparent to those skilled in the art, and the invention itself will be best understood by reference to the following detailed description read in conjunction with the accompanying drawings.

DETAILED DESCRIPTION OF SPECIFIC EMBODIMENTS

Figure 1:
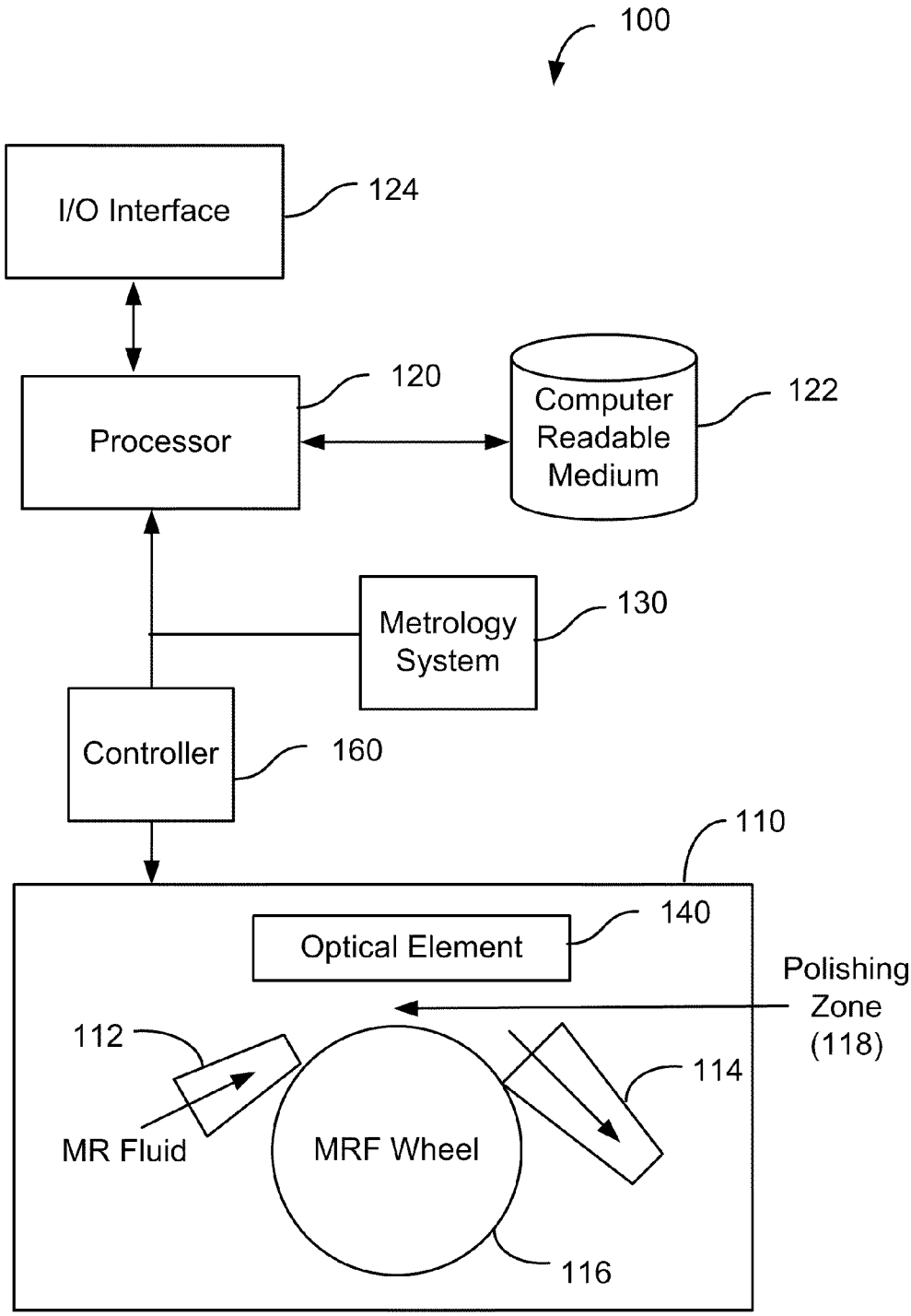
FIG. 1 is a simplified schematic diagram of an optical element processing system according to an embodiment of the present invention.

According to embodiments of the present invention, advanced magnetorheological finishing (MRF) techniques are applied to optical elements (e.g., Ti:sapphire crystals) to compensate for sub-millimeter lattice distortions that occur during the crystal growth process. Precise optical corrections are made by imprinting topographical structure onto the surfaces of the optical element to cancel out the effects of the lattice distortion in the transmitted wavefront. The embodiments of the present invention described herein significantly improve the optical quality for optical elements and provide a means for fabricating high-quality large-aperture sapphire and Ti:sapphire optics useful in a wide variety of applications.

Ti:sapphire has become the premier material for solid-state femtosecond high-peak power laser systems because of its wide bandwidth wavelength tuning range. With a tuneable range from 680 to 1100 nm, peaking at 800 nm, Ti:sapphire lasing crystals can easily be tuned to the required pump wavelength and provide very high pump brightness due to their good beam quality and high output power of typically several watts. Femtosecond lasers are used for precision cutting and machining of materials ranging from steel to tooth enamel to delicate heart tissue and high explosives. These ultra-short pulses are too brief to transfer heat or shock to the material being cut, which means that cutting, drilling, and machining occur with virtually no damage to surrounding material. Furthermore, these lasers can cut with high precision, making hairline cuts of less than 100 μm in thick materials along a computer-generated path. Extension to higher energies is limited by the size of the crystal lasing medium. Yields of high-quality large-diameter crystals have been constrained by lattice distortions that may appear in the boule, limiting the usable area from which high quality optics can be harvested. Lattice distortions affect the transmitted wavefront of these optics, which ultimately limits the high-end power output and efficiency of the laser system, particularly when operated in a multi-pass mode. Furthermore, Ti:sapphire or sapphire is extremely hard (Mohs hardness of 9 with diamond being 10), which makes it extremely difficult to accurately polish using conventional methods without subsurface damage or significant wavefront error. Although embodiments of the present invention are discussed in the context of Ti:sapphire applications, the present invention is not limited to this particular crystal and other optical media are included within the scope of the present invention. These optical media include sapphire, sapphire doped with other transition metals, other laser gain media, and the like.

According to embodiments of the present invention, methods and systems employing MRF are provided that compensate for the lattice distortions in Ti:sapphire by perturbing the transmitted wavefront. These advanced MRF techniques allow for precise polishing of the optical inverse of lattice distortions with magnitudes of about 70 nm in optical path difference onto one or both of the optical surfaces to produce high quality optics from otherwise unusable Ti:sapphire crystals. The techniques include interferometric, software, and machine modifications to precisely locate and polish sub-millimeter sites onto the optical surfaces that can not be polished into the optics using conventional techniques. The inventors believe that the methods and systems described herein may allow extension of Ti:sapphire based systems to peak powers well beyond one petawatt.

One of the limiting yield factors for harvesting high-quality large-diameter optics from Ti:sapphire and other crystals is the presence of lattice distortions and discrete inhomogeneities that occur during crystal growth. These imperfections manifest themselves as localized refractive index changes in the crystal's interior that deteriorate the transmitted wavefront quality, despite the fact that the surfaces may be extremely flat. Based on interferometric phase profile measurements, the distortions can vary from about 0.3-5 mm in width. This distortion is large enough to disrupt the quality of a laser beam, which can cause damage to optics downstream in a laser system, and for short pulse systems can lead to incomplete compression and poor ability to focus the laser beam. As a result, laser optics including Ti:sapphire crystals that have these types of lattice distortions are less desirable for applications that require superior transmission characteristics and beam quality.

Conventional MRF techniques only compensate for long spatial period phase distortions on the order of 3 mm or greater. Embodiments of the present invention provide MRF techniques that are able to compensate for the sub-millimeter lattice distortions of sapphire and Ti:sapphire crystals to improve the transmitted wavefront. The techniques described herein are applicable to correcting shorter period phase distortions and discrete inhomogeneities in a unique manner to both glass and crystalline materials. As described more fully below, the design and introduction of fiducialized MRF fixtures has enabled the accurate location of interferometric features at an absolute location in the optical plane. Additionally, we have implemented interferometric manipulation algorithms to relate fiducial locations to interferogram locations and an enhanced fiducial camera system that links fixtures and fiducials to within 3 μm relative to the MRF machine position. Furthermore, we have implemented small and precisely controlled MRF removal functions. The MRF removal function is defined by a variety of factors including: the magnetic field in the polishing zone, the depth at which the optical element is immersed into the MR ribbon, the MRF wheel diameter, the MR fluid viscosity, the MR fluid ribbon width, and the like. The inventors have tailored these various factors to provide a highly controllable MRF process with improved performance with respect to conventional MRF techniques. As an example, the removal function length is a function of the wheel diameter and the removal function width is a function of the amount of immersion of the optic into the MR ribbon. The peak and volumetric removal rate is a function of the wheel speed, fluid viscosity, and the strength of the magnetic field. These improvements make it is possible to achieve low transmitted wavefronts in Ti:sapphire, sapphire crystals, other optical elements. Embodiments of the present invention provide for removal of materials with an effective diameter of less than 1 mm using a 50 mm MRF wheel. Even smaller diameters are provided when smaller MRF wheels are utilized.

MRF offers a direct approach for imprinting smooth topographical features onto optics without the use of masks or master plates. The deterministic polishing capability provided by MRF systems and close interplay with interferometry enable imprinting of phase structures that vary continuously across the whole beam aperture with no sharp discontinuities or phase anomalies. The technology is capable of, and routinely produces, highly accurate topographical profiles with errors of about 30 nm rms over the optic aperture, thereby yielding highly efficient plates (>99 percent) whose characteristics are precisely defined.

FIG. 1 is a simplified schematic diagram of an optical element processing system according to an embodiment of the present invention. The MRF system 100 includes an MRF polishing tool 110 with enhanced capabilities in comparison to conventional tools. The MRF polishing tool 110 includes an MRF wheel 116. MR fluid is provided through fluid inlet 112 and forms a ribbon on the MRF wheel 116 in the polishing zone 118. After passing through the magnetic field in the polishing zone 118, the MR fluid is collected in fluid outlet 114 and recirculated to the fluid inlet 112 using a pump (not shown). The optical element 140 moves with respect to the MRF wheel 116, for example, in a raster scan, circular, or other pattern to polish the surface of the optical element 140.

The MRF system also includes an I/O interface 124 that enables a user to program the MRF tool and interact with other system elements. The MRF system has a processor 120 that is used to perform calculations related to dwell times and other system parameters. A computer readable medium 122 (also referred to as a database or a memory) is coupled to the processor 120 in order to store data used by the processor and other system elements. The processor 120 interacts with a metrology system 130, which provides data on the surface structure of the optical element as well as the internal non-uniformities inside the optical element. Typically, the metrology system 130 includes an interferometer that provides spatially resolved phase information for the optical element. Using the processor 120, the memory 122, and the I/O interface 124, a user is able to calculate the system parameters and dwell time for the optical element to form a predetermined shape on the optical element. The controller 160 interacts with the MRF tool 110 to accomplish the deterministic polishing process.

The processor 120 can be a general purpose microprocessor configured to execute instructions and data, such as a Pentium processor manufactured by the Intel Corporation of Santa Clara, Calif. It can also be an Application Specific Integrated Circuit (ASIC) that embodies at least part of the instructions for performing the method in accordance with the present invention in software, firmware and/or hardware. As an example, such processors include dedicated circuitry, ASICs, combinatorial logic, other programmable processors, combinations thereof, and the like.

The memory 122 can be local or distributed as appropriate to the particular application. Memory 512 may include a number of memories including a main random access memory (RAM) for storage of instructions and data during program execution and a read only memory (ROM) in which fixed instructions are stored. Thus, memory 512 provides persistent (non-volatile) storage for program and data files, and may include a hard disk drive, flash memory, a floppy disk drive along with associated removable media, a Compact Disk Read Only Memory (CD-ROM) drive, an optical drive, removable media cartridges, and other like storage media.

Figure 2A:
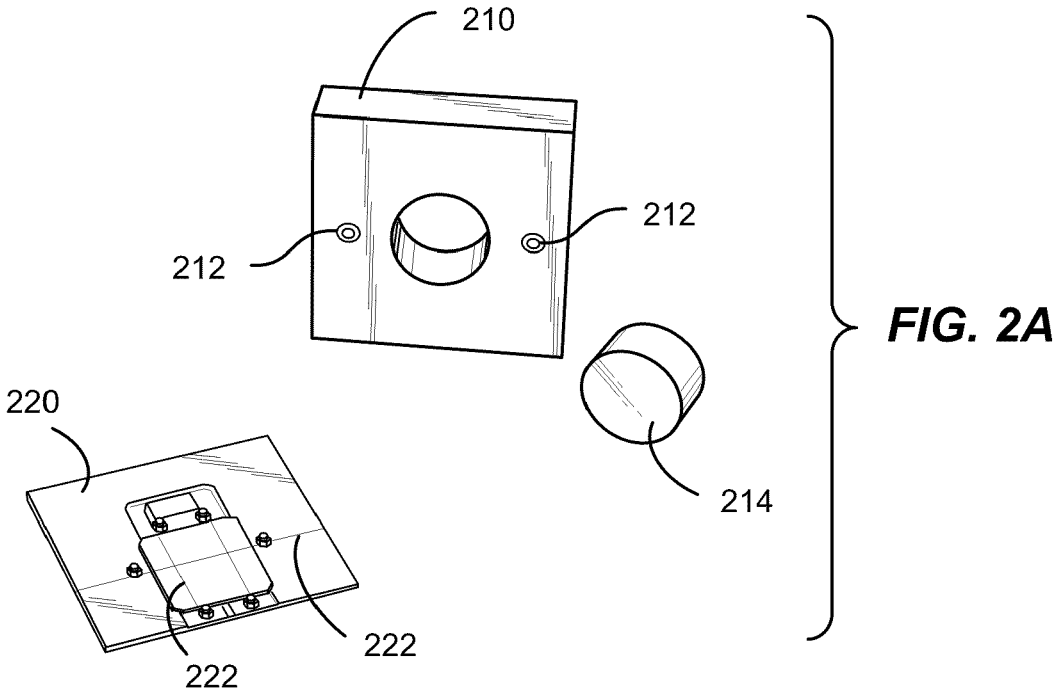
FIG. 2A is a simplified schematic diagram illustrating elements used in an MRF tool according to an embodiment of the present invention.

FIG. 2A is a simplified schematic diagram illustrating elements used in an MRF tool according to an embodiment of the present invention. An optical mount 210 is utilized in some embodiments that is sized to receive and securely support an optical element 214 during the MRF polishing process. The optical mount 210 may have external fiducials 212 provided in a fixed manner on the surface or embedded in the optical mount 210. In an embodiment, fiducials 212 as illustrated in FIG. 2A are provided in the form of cross hairs that are integrated into the optical mount. In other embodiments, other forms of fiducials are utilized as appropriate to the particular implementation. In other embodiments, the fiducials are circles, or other suitable fiducials that facilitate alignment of the optical mount 210 in the MRF tool. The other elements of the MRF system can include a fiducial mask 220 that includes a plurality of fine wires 222 forming a grid in the central portion of the fiducial mask. Although a grid with orthogonal features is illustrated in FIG. 2A, this is not required by the present invention and other arrangements are included within the scope of the present invention.

When the optical element 214 is mounted in the optical mount 210 and the fiducial mask 220 is placed on the optical mount 210, the optical element is accurately registered to the optical mount and fiducial mask. As described more fully in relation to FIG. 4, the methods and systems described herein utilize this accurate registration in performing the MRF polishing processes.

Figure 2B:
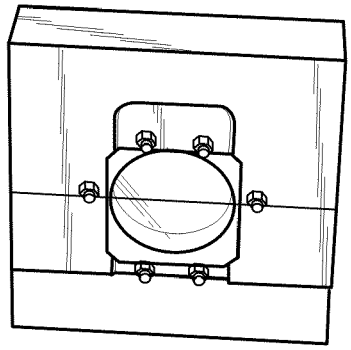
FIG. 2B is a simplified schematic diagram of an optical element mounted in the optical mount with a fiducial mask according to an embodiment of the present invention.

FIG. 2B is a simplified schematic diagram of an optical element mounted in the optical mount with a fiducial mask according to an embodiment of the present invention. As shown in FIG. 2B, the optical element is positioned in a predetermined geometry with respect to the optical mount 210 and the fiducial mask 220. As described more fully throughout the present specification, the accurate registration between the optical element and the mounting fixtures will enable precise polishing of the optical element using the MRF process. Thus, embodiments of the present invention provide for optical element mounts that contain kinematic fiducial masks overlapping portions of the optical element or external to the optical element. The external fiducials may be included as part of the optical element mount as illustrated by external fiducials 212 in FIG. 2A.

Figure 3:
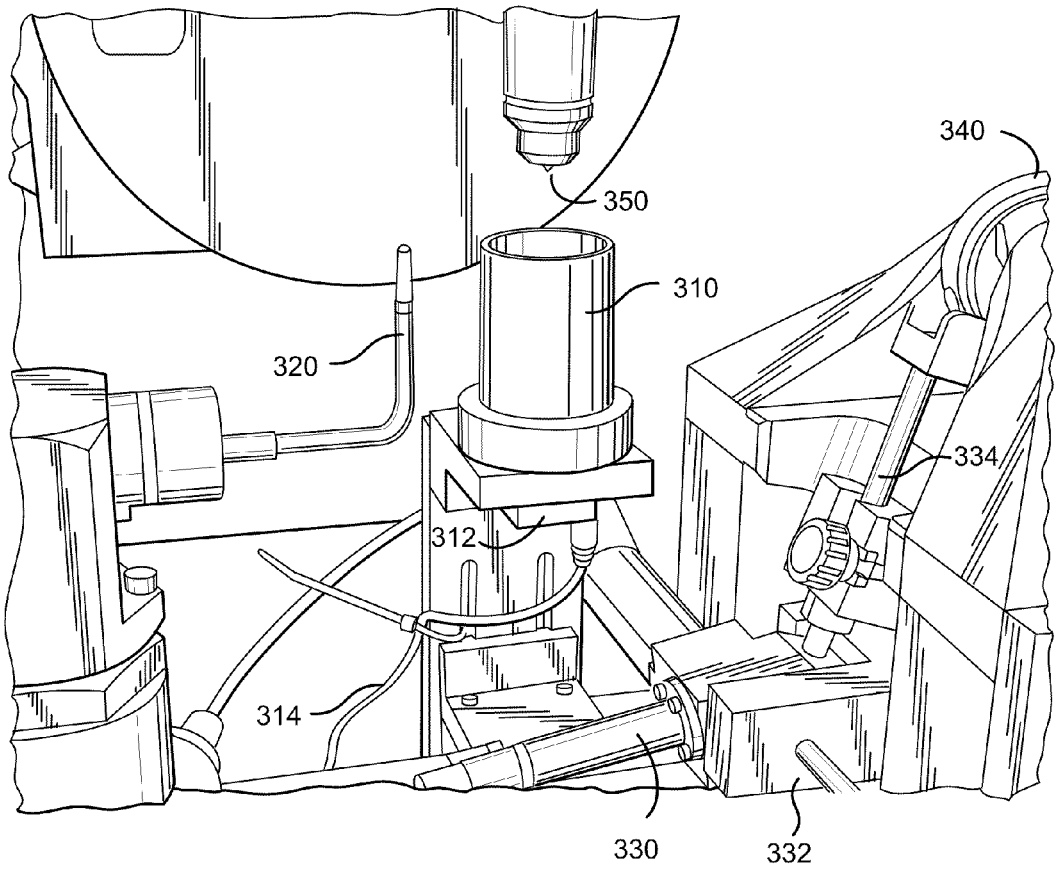
FIG. 3 is a simplified schematic diagram illustrating elements of an MRF registration system according to an embodiment of the present invention.

FIG. 3 is a simplified diagram illustrating elements of an MRF registration system according to an embodiment of the present invention. As illustrated in FIG. 3, embodiments of the present invention utilized a modified camera system assembly installed on an MRF tool that enables translation in multiple dimensions and rotation to provide for stage positioning on the order of microns. In one embodiment, the stage positioning is accurate to less than 10 μm. In another embodiment, the stage positioning is accurate to less than 5 μm (e.g., 2 μm-5 μm).

The system includes a microscope objective (not shown), which is mounted in the housing 310. The microscope objective can be a zoom lens or other suitable optical lens. Light passing through the microscope objective is focused on digital sensor 312, which is a charge coupled device (CCD) camera in one embodiment. Other suitable imaging devices can be utilized as appropriate to the particular application. The signal from the digital sensor 312 is routed through connector cable 314 to suitable control electronics.

The system also includes a position gauge 320 that is used to measure the position of the optical element as it is moved into position. In the embodiment illustrated in FIG. 3, the position gauge 320 includes a tip that is activated by contact with the optical element, providing the system with accurate information on the position of the face of the optical element. The MRF wheel 340 receives MR fluid from nozzle 334, which is in fluid communication with supply line 300, which in turn, is in fluid communication with MR fluid pumped from the pumping system (not shown). The nozzle 334 is positioned on stage 332 and is operable to move in one more or more direction in order to position the nozzle adjacent the MRF wheel.

During alignment procedures, the optical element is positioned above the housing 310 and the digital sensor 312 in the position associated with alignment pin 350. During finishing/polishing operations, the optical element is positioned above the MRF wheel 340.

Utilizing embodiments of the present invention, the MRF wheel 340 is operable to provide a removal function ranging from about 50 μm to about 30 mm in spatial extent. In a particular embodiment, the removal function is less than about 200 μm in spatial extent. The camera system including the digital sensor 312 provides a resolution ranging from about 1 μm to about 100 μm. In a specific embodiment, the resolution is less than about 20 μm.

Embodiments of the present invention utilize a camera system on the MRF machine to take advantage of the fiducial mask 220 or other suitable fiducials such as fiducials 212 in the interferometry or metrology system once the structure illustrated in FIG. 2B is placed in the MRF tool 110. The camera system enables the operator to identify the fiducials with a high level of accuracy the MRF tool. The camera system includes a microscope objective that enables highly accurate imaging of the fiducials utilized in the system. As an example, using the camera system described herein, the inventors have been able to image a 40 μm feature and align the optical element accordingly.

In an alternative embodiment, a zoom lens is utilized that enables the imaging system elements to be moved farther away from the optical element, increasing the field of view of the imaging system. Using this zoom lens, the operator is able to capture the gross alignment and then to zoom in to capture details of the fiducials and perform accurate alignment as a result.

Figure 4:
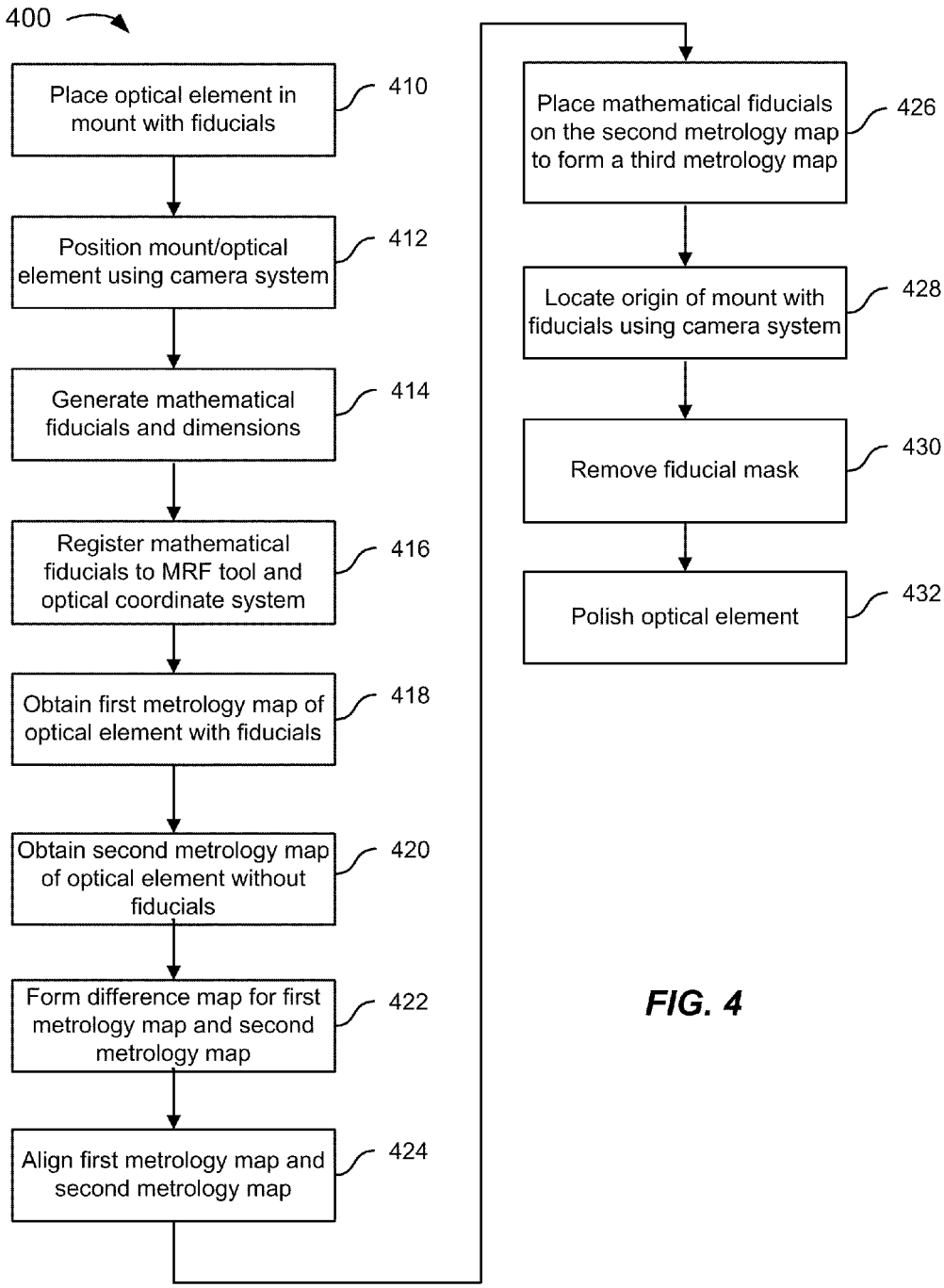
FIG. 4 is a simplified flowchart illustrating a method of finishing an optical element according to an embodiment of the present invention.

FIG. 4 is a simplified flowchart illustrating a method of finishing an optical element according to an embodiment of the present invention. The method 400 includes placing an optical element in a mount with fiducials (410). An example of this step is shown in FIG. 2B. The mount including the optical element is positioned in the MRF system using the high magnification camera system described in relation to FIG. 3. Positioning of the mount can include locating the origin of the mount and the fiducial locations with respect to the MRF tool.

Figure 5:
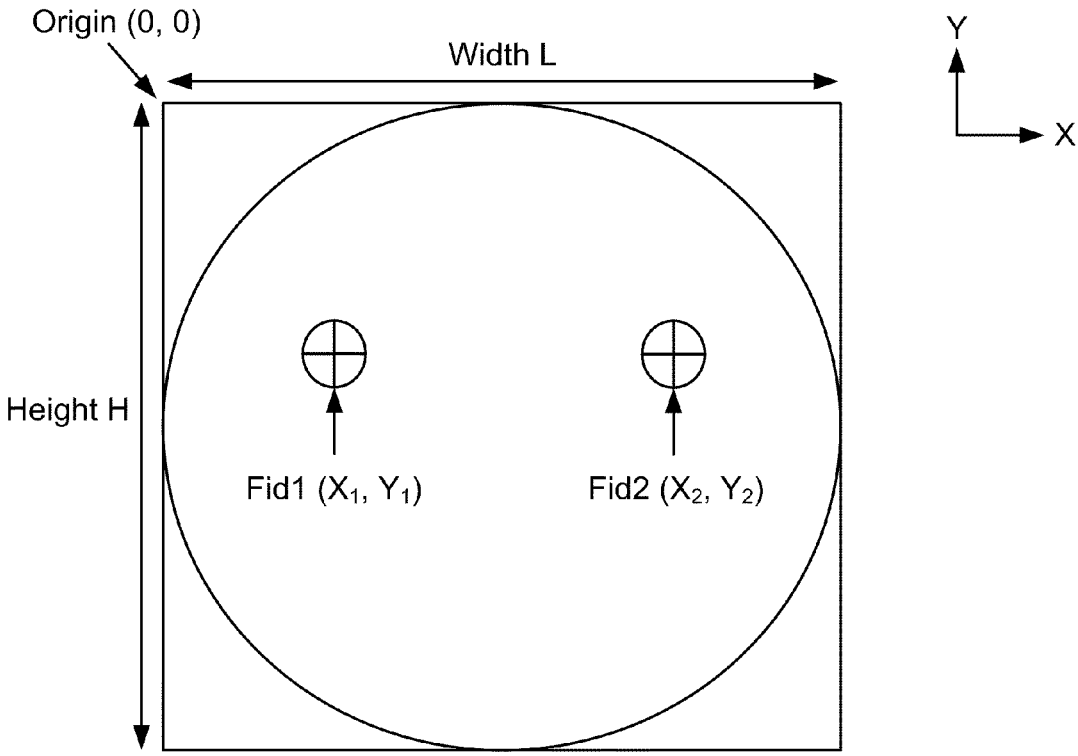
FIG. 5 is a simplified diagram of an optical mount according to an embodiment of the present invention.

FIG. 5 is a simplified diagram of an optical mount according to an embodiment of the present invention. Referring to FIG. 5, an example of an optical mount is provided including the origin defined at the top left corner of the mount and having a width and a length. Two fiducial locations Fid1 and Fid2 are illustrated at coordinates $(x_1, y_1)$ and $(x_2, y_2)$, respectively. The origin location, axis coordinate system, and fiducials can be established with respect to the MRF system using the high magnification camera system.

The mount/optical element is positioned in the MRF tool using a high resolution camera system (412). Typically, the MRF tools have several degrees of freedom including in x, y and z, rotational, and tilting motions. Thus, a fiducialized optical mount can be aligned to the MRF Tool using the camera system illustrated in FIG. 3 and the fiducials can be visited by the tool during the alignment process.

A mathematical representation of the optical element and the fiducial locations for the MRF tool are developed in order to associate the MRF and the optical element coordinate system. This step can also be referred to as generating mathematical fiducials and system dimensions (414). Using this step, the optical element and the MRF coordinate system are associated in a mathematical model. The mathematical fiducials are then registered to the MRF tool and the optical coordinate system (416).

Figure 7A:
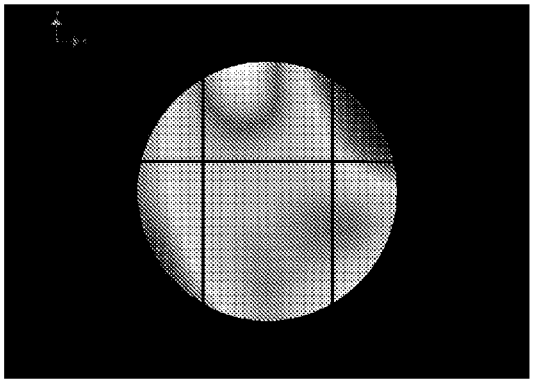
FIGS. 7A-7F are interferograms measured or computed at various stages of the process for associating and aligning the optical element to the MRF system.

A first metrology map of the optical element with the fiducials is obtained (418). In an embodiment, the fiducials are physically separated from the optical element, for example, the fiducials 212 on the optical mount 210 or the fiducial mask 220 illustrated in FIG. 2A. As described more fully below, the first metrology map with the fiducials is used to reference the position of the fiducials (e.g., crosshairs on the fiducial mask) to various physical features, e.g., non-uniformities, present on the surface or inside the optical element to be polished. An example of a first metrology map is an interferogram showing the fiducial map in place as illustrated by FIG. 7A. Referring to FIG. 7A, the wires 222 form crosshairs at two locations overlapping the optical element. Variations in the surface profile of the optical element and/or internal variations are illustrated by the color differences in FIG. 7A.

Figure 7D:
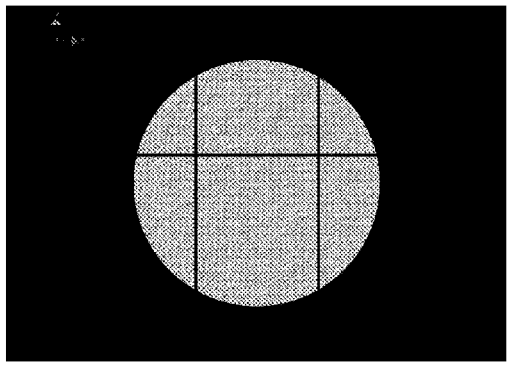
Figure 7B:
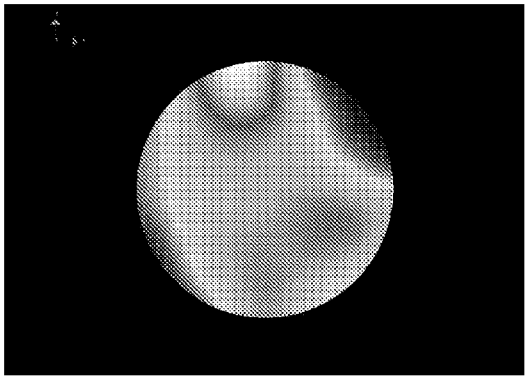

The method 400 also includes obtaining a second metrology map of the optical element without the fiducials (420). The second metrology map only includes information on the optical element and whatever non-uniformities are present on the surface or inside the optical element. In an embodiment, the second metrology map is a phase map, e.g., an interferogram of the transmitted wavefront for the particular optical element that is measured as illustrated in FIG. 7B. The second metrology map includes contributions from both surfaces of the optical element ($S_1$ and $S_2$) as well as internal non-uniformities present in the optical element, sometimes referred to as bulk non-uniformities. For Ti: sapphire, these bulk non-uniformities (i.e., variations in refractive index) can include striations, scratches, digs, grain boundaries, diffusion bond interfaces, and the like. Embodiments of the present invention enable optics that have unacceptable non-uniformities to be processed into optics that are suitable for high power and other applications. Thus, yield for the optics can be increased markedly in comparison with conventional techniques.

In some embodiments, in order to obtain the second metrology map, the optical mount is removed from the metrology tool in order to remove the fiducial mask. In this case, when the second metrology map is obtained, there may be a registration error in the metrology machine between the first metrology map and the second metrology map. In other words, the first and second interferograms may not be registered to each other. Embodiments of the present invention utilize alignment software to compare the two metrology maps against each other and minimize the error between them, effectively lining up the two metrology maps so that the fiducials can be effectively transferred from the second metrology map as described more fully below.

Figure 7E:
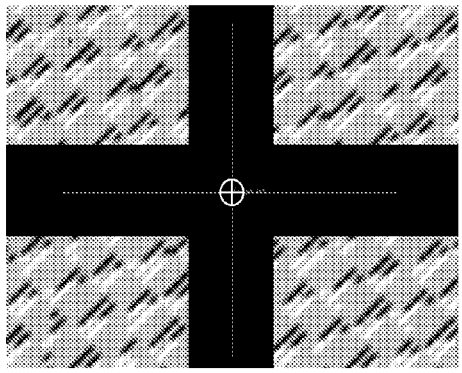
Figure 7C:
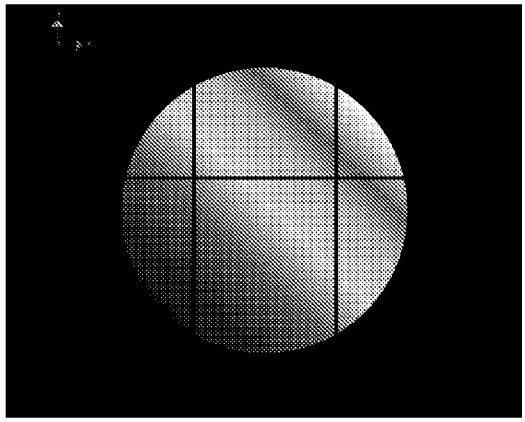

The method 400 further includes forming a difference map for the first metrology map and the second metrology map (422). In an embodiment, software developed for the MRF system is utilized to form the difference map. Referring to FIG. 7C, an unoptimized difference interferogram is illustrated as an example of the difference map. As illustrated in FIG. 7C, the fiducials are present in the interferogram as well as a linear variation oriented at an angle of approximately 45 degrees to a horizontal line. The origin of this linear variation is due to wedge or tip/tilt error resulting from the metrology process. This wedge will be removed as described below.

The first metrology map and the second metrology map are aligned (424). In some embodiments, affine transformations are used to align the first metrology map and the second metrology map. This step associates the fiducial locations between the two metrology maps. FIG. 7D illustrates a difference interferogram of the optical element that is optimized in three dimensions (x, y, and z) using affine transformations to minimize the variance. As shown in FIG. 7D, the wedge present in FIG. 7C is removed.

In some embodiments error minimization is used as part of step 424 to compensate for the finite dimensions of the fiducials. As an example, the wires used in the fiducial mask 220 illustrated in FIG. 2A have a finite width, for example, widths ranging from about 25 μm to about 500 μm. As an example, error minimization identifies the width of the wires along on the entire length and allows the operator to then draw straight lines for quite a distance. The widths are averaged to determine the center of the line and establish the location of the fiducial at the center of the crossed lines, which is more accurate than the range of positions covered by the line width.

Error minimization can also be used to compensate for diffraction from the fiducials that results in error in the metrology map including the fiducials. As an example, diffraction around wires used as fiducials, will result in data in the metrology map with fiducials, not just from the wire, but from light diffracted by the wire. Thus, the presence of the wire will result in not just an image of the wire, but for several pixels adjacent to the image of the wire, light that has been diffracted around the edge of that wire. This diffracted light will contaminate the measurement of the edge of the wire.

Figure 7F:
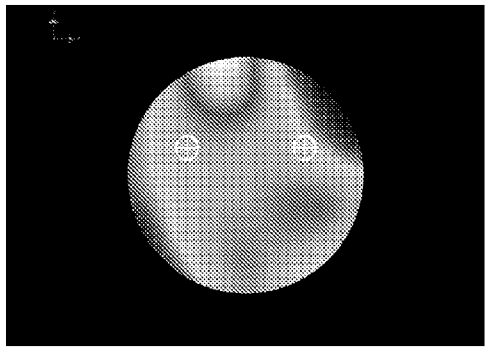

Mathematical fiducials are placed onto the second metrology map to form a third metrology map (426). The mathematical fiducials are placed on the second metrology map using the difference map formed in step 422 in an embodiment. Referring to FIG. 7E, the placement of one of the mathematical fiducials on the second metrology map is illustrated. As will be evident to one of skill in the art, multiple mathematical fiducials can be placed on the second metrology map. In some embodiments, the placement of the mathematical fiducials can be performed with sub-pixel accuracy. The third metrology map (the metrology map without fiducials with the mathematical fiducials added) is now associated with the optical element to be polished and the MRF coordinate system so that the MRF system can be used to polish the optical element. An example of a third metrology map is illustrated in FIG. 7F, which is the interferogram without the fiducials plus the mathematical fiducials. The result of the process described herein is to associate and accurately align the optical element coordinate system with the MRF system and interferometry coordinate systems. Referring to FIGS. 5 and 7F, Fid1 is aligned with the mathematical fiducial on the left side of the interferogram and Fid2 is aligned with the mathematical fiducial on the right side of the interferogram. In this manner, FIG. 5 illustrates association of the MRF system and the optical element coordinate system and FIG. 7F illustrates association of the metrology (interferometry) system and the optical element coordinate system.

The origin of the mount including the optical element is located using the high resolution camera system (428). The mount including the optical element is placed on the MRF tool, the fiducial mask is removed (430) and the optical element is polished (432).

Thus, using the methods and systems described herein, the MRF tool is able to accurately register the removal function to the metrology map of the optical element and the corresponding non-uniformities. Once the MRF tool is registered to the optical element in this manner, the optical element is polished to form predetermined features on the surface of the optical element.

It should be appreciated that the specific steps illustrated in FIG. 4 provide a particular method of polishing an optical element according to an embodiment of the present invention. Other sequences of steps may also be performed according to alternative embodiments. For example, alternative embodiments of the present invention may perform the steps outlined above in a different order. Moreover, the individual steps illustrated in FIG. 4 may include multiple sub-steps that may be performed in various sequences as appropriate to the individual step. Furthermore, additional steps may be added or removed depending on the particular applications. One of ordinary skill in the art would recognize many variations, modifications, and alternatives.

In summary, the first metrology map of the optical element with fiducials is used to transfer the fiducials to the second metrology map (free from contribution from the fiducials) as a mathematical construct. Thus, in the second metrology map, mathematical fiducials are inserted to register the non-uniformities in the metrology map to the mathematical fiducials. Then, the fiducials can be used to define landmarks, which are aligned to the MRF tool. Thus, the MRF tool aligns to the landmarks, which are registered to the mathematical fiducials, which are registered to the non-uniformities in the optical element. Thus, the MRF tool is able to deterministically polish the non-uniformities present in the optical element. Additionally, the MRF tool is able to introduce non-uniformities in the optical element as desired.

As illustrated in FIGS. 7A-7F, interferograms utilized as metrology maps in embodiments of the present invention. These interferograms are two dimensional arrays with entries associated with position and the phase height associated with a particular element of the array. Utilizing embodiments of the present invention, the phase information in the interferogram used for polishing the optical element (e.g., FIG. 7F) is only associated with non-uniformities on the surfaces and in the bulk of the optical element. Thus, the interferogram is not contaminated with phase information related to the fiducials, but includes registration data for the fiducials.

In a technique with physical fiducials on the optical element, the metrology map that is produced has not only phase information related to the surfaces and bulk of the optic, but also phase information related to the fiducials. The fiducials, therefore, "contaminate" the metrology map. If such a metrology map were used in polishing the optic, the MRF tool would try to correct for this contamination, resulting in an unsuccessful outcome. According to embodiments of the present invention, the metrology map used in polishing the optical element (i.e., a metrology map based on the second metrology map) is free from contamination resulting from the fiducials.

Figure 6:
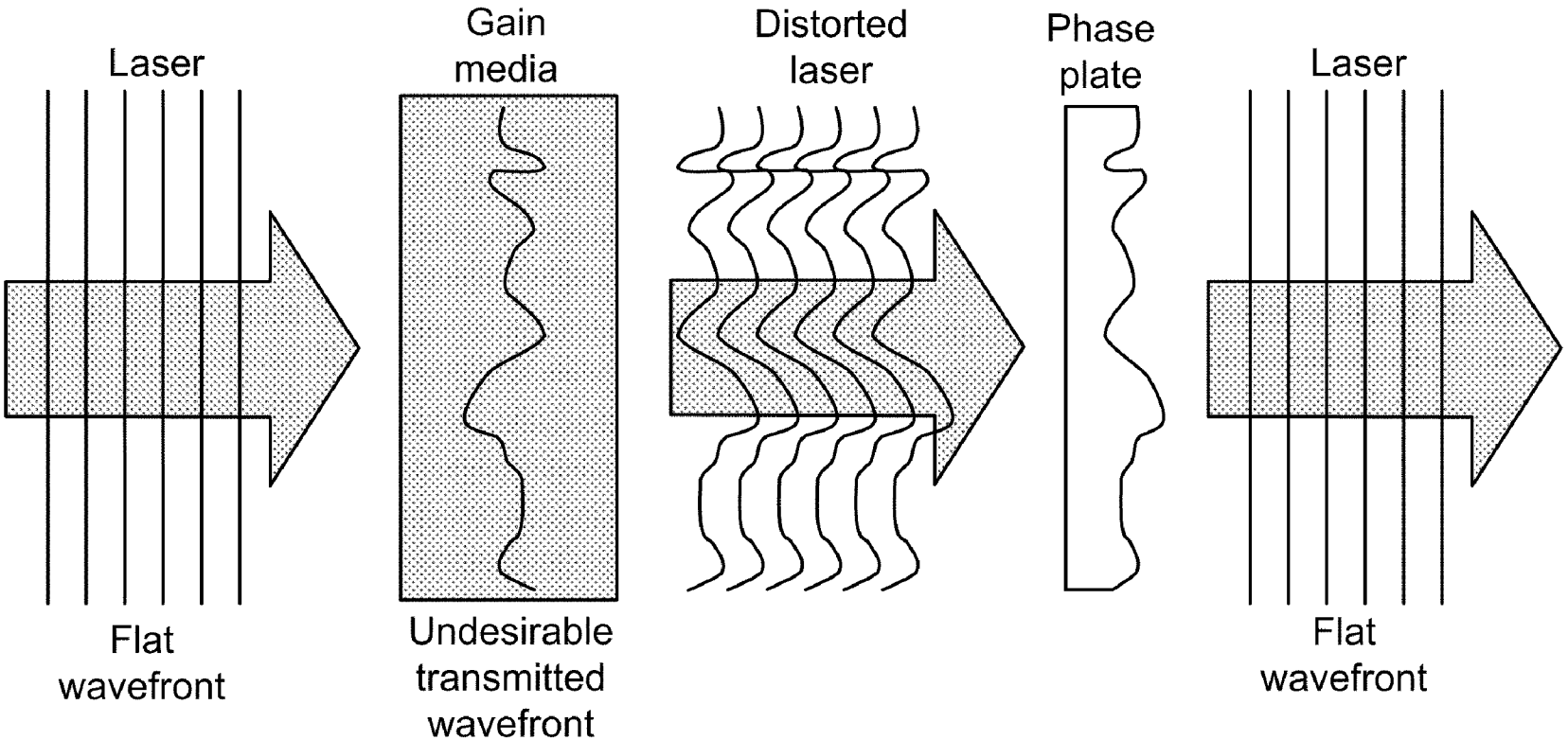
FIG. 6 is a simplified illustration of a system for correcting wavefront distortions according to an embodiment of the present invention.

FIG. 6 is a simplified illustration of a system for correcting wavefront distortions according to an embodiment of the present invention. In FIG. 6, a laser beam with a flat (i.e., uniform) wavefront is propagating to the right. The example gain media (e.g., a Ti:sapphire crystal) has perfectly flat front and back surfaces, but a non-uniform index profile as a function of position, illustrated by the crooked line passing through the gain media. In real applications, the surfaces will not be perfectly flat, contributing to index variations as a function of position. Thus, embodiments of the present invention consider the variations at the front and back surfaces as well as internal variations in a combined manner, lumping all variations into a single phase variation measurement as a function of position. Although a gain media is illustrated in FIG. 6, embodiments of the present invention are not limited to gain media but can be applied to other optical elements that are passive, for example, phase plates, lenses, and the like.

Because of the phase variations resulting from propagation through the gain media, the laser wavefront is distorted. Focusing of the distorted laser beam will result in non-diffraction limited performance. Additionally, amplification of the distorted laser beam can result in additional increases in wavefront nonuniformity. In order to remove the distortion from the distorted laser beam, a phase plate is inserted into the optical path to compensate for the variations in the wavefront. After passing through the phase plate, the laser beam is once again characterized by the initial flat wavefront.

The phase plate can be integrated with the gain media by finishing one or both surfaces of the gain media to compensate for phase variations associated with the gain media. In an embodiment, the first and second surfaces of the gain media are polished to a "smooth" finish. Metrology is used to characterize the overall phase variation of the gain media as a function of position. The overall phase variation will result from imperfections in the surface profiles as well as internal inhomogeneities. Then one of the surfaces is finished using the MRF system described herein to compensate for the overall phase variation. Thus, after propagating through the MRF finished gain media, a flat wavefront is produced.

Figure 8B:
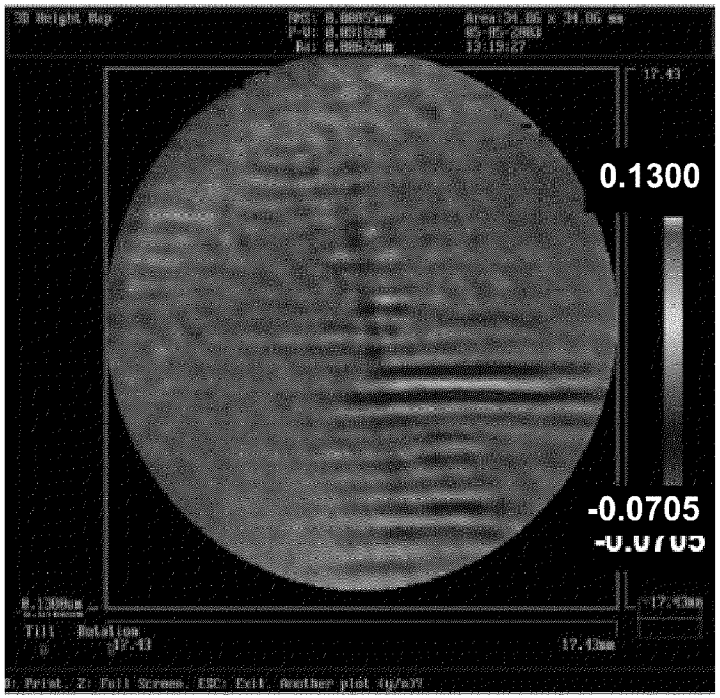
FIGS. 8A and 8B are phase profiles for an optical element before and after long wavelength MRF processing, respectively, according to an embodiment of the present invention.
Figure 8A:
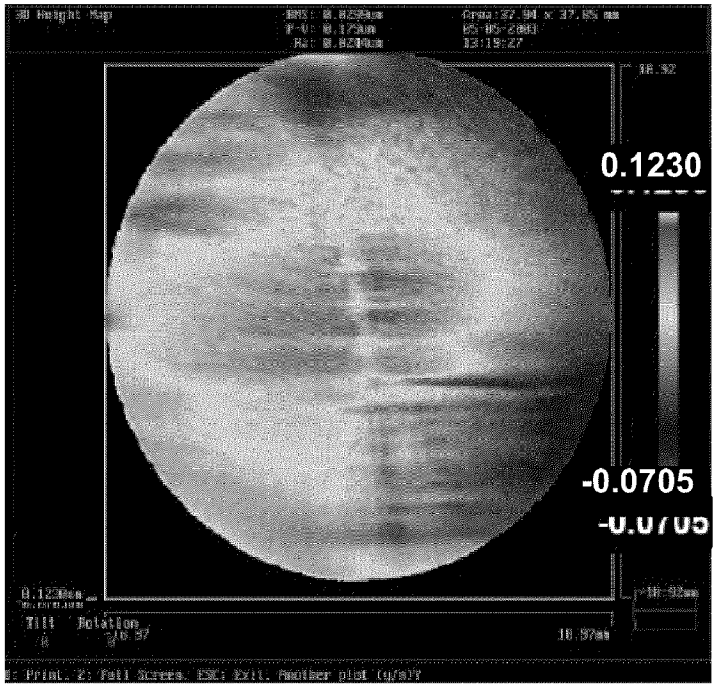

FIGS. 8A and 8B are phase profiles for an optical element before and after long wavelength MRF processing, respectively, according to an embodiment of the present invention. As illustrated in FIG. 8A, before MRF polishing, the rms figure error was 0.030 μm with a peak to valley distance of 0.179 μm, which is equivalent to ~λ/6 at 1064 nm. After MRF polishing as illustrated in FIG. 8B, the rms figure error was 0.008 μm with a peak to valley distance of 0.091 μm, which is equivalent to ~λ/11.5 at 1064 nm. Thus, improvements in the transmitted wavefront of about a factor of two was achieved for long wavelength variations. It should be appreciated that the phase profiles illustrated in FIGS. 8A and 8B are for transmitted wavefronts. As a result, these phase profiles represent compensation for figure ($S_1$ and $S_2$) and homogeneity (i.e., bulk) for the optic.

Figure 9A:
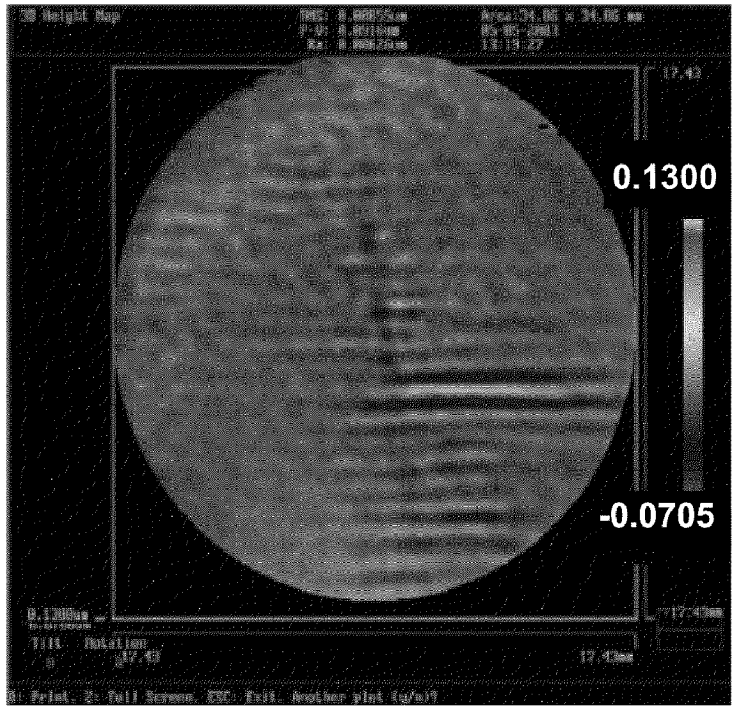
FIGS. 9A and 9B are phase profiles for an optical element before and after short wavelength MRF processing, respectively, according to an embodiment of the present invention.
Figure 9B:
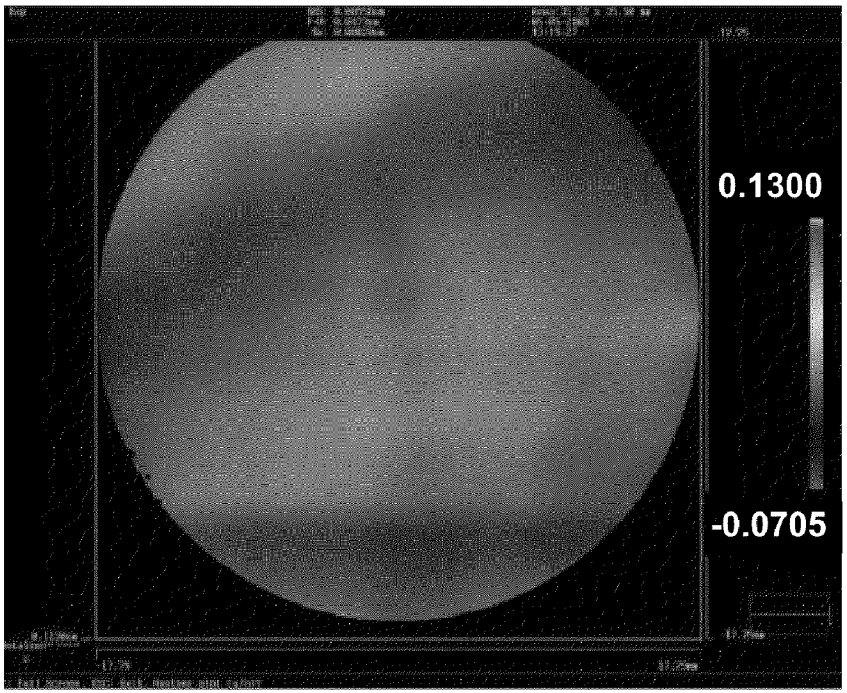

FIGS. 9A and 9B are phase profiles for an optical element before and after short wavelength MRF processing, respectively, according to an embodiment of the present invention. As illustrated in FIG. 9A, before MRF polishing to correct short wavelength variations, the rms figure error was 0.008 μm with a peak to valley distance of 0.091 μm, which is equivalent to ~λ/11.5 at 1064 nm. FIG. 9B illustrates the phase profile after MRF polishing using the system described herein to remove short wavelength variations. The rms figure error was 0.009 μm, which was comparable to the initial rms figure error, but the peak to valley distance has been reduced to 0.047 μm, which is equivalent to ~λ/22.3 at 1064 nm. Thus, improvements in the transmitted wavefront of about a factor of four in comparison to the initial state and a factor of two in comparison to post-long wavelength polishing.

Figure 10:
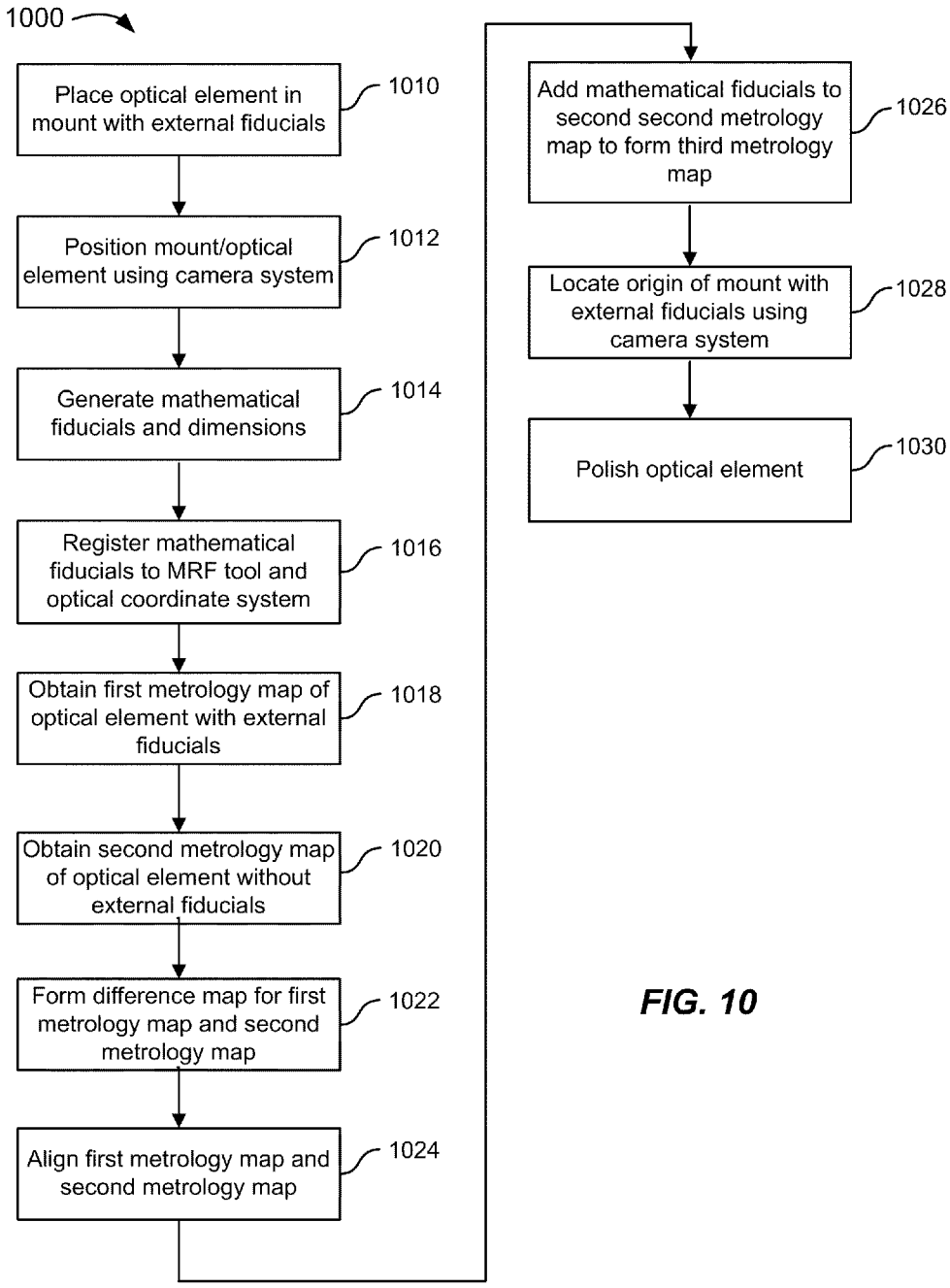
FIG. 10 is a simplified flowchart illustrating a method of polishing an optical element according to another embodiment of the present invention.

FIG. 10 is a simplified flowchart illustrating a method of polishing an optical element according to another embodiment of the present invention. The steps illustrated in FIG. 10 share some commonalities with those illustrated in FIG. 4. The embodiment discussed in relation to FIG. 10 uses fiducials that are physically separated from the optical element (not overlapping) and enable the creation of mathematical fiducials that provide mathematical points registered to the optical element. The method 1000 includes placing an optical element in a mount with external fiducials (1010). The external fiducials are positioned so that they are visible when placed in the MRF system. An example of such a mount is illustrated in FIG. 2A. The mount with external fiducials and the optical element mounted therein is positioned in the MRF system using the high magnification camera system described in relation to FIG. 3. Positioning of the mount can include locating the origin of the mount and the fiducial locations with respect to the MRF tool.

Figure 11:
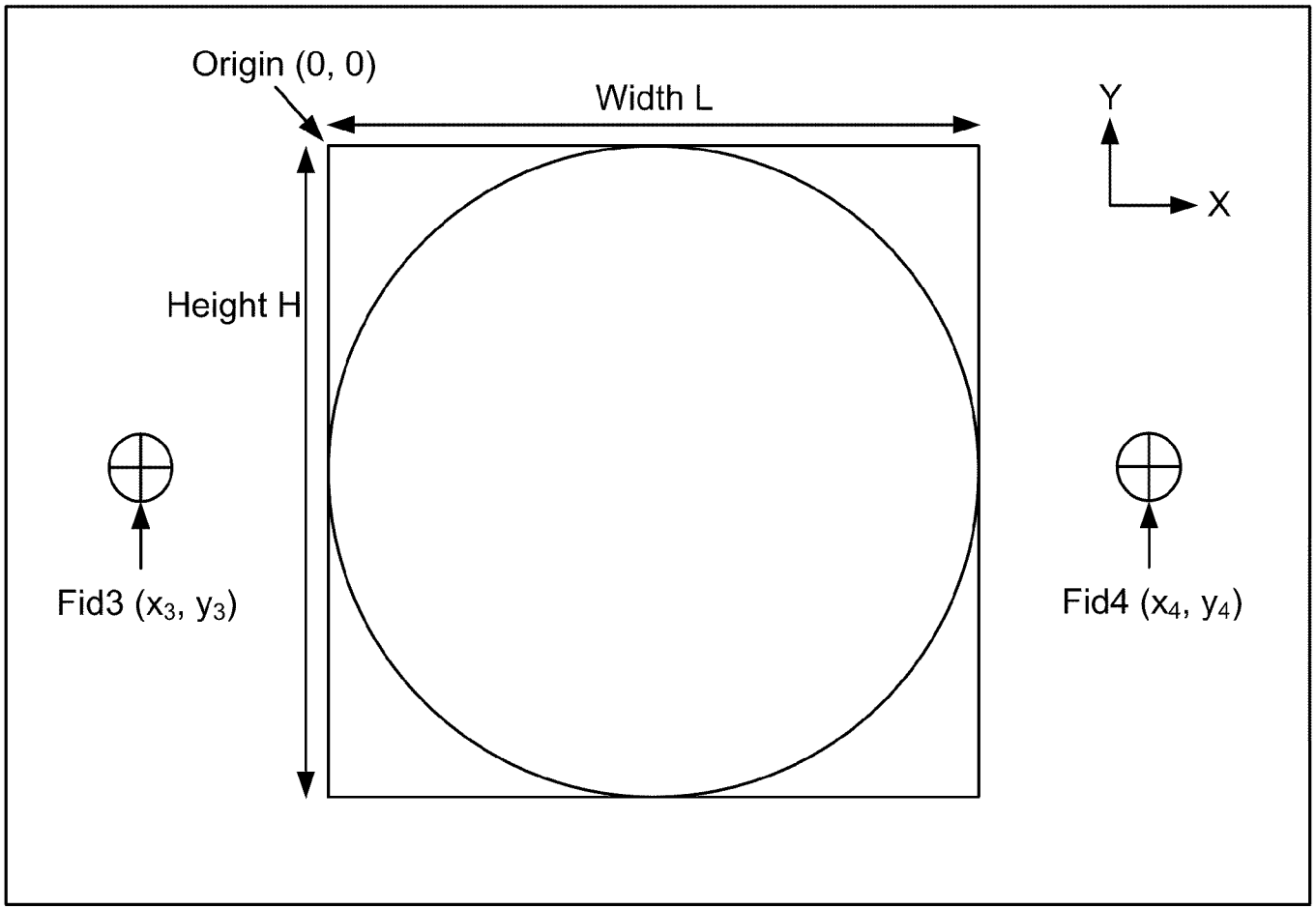
FIG. 11 is a simplified diagram of an optical mount with external fiducials according to an embodiment of the present invention.

FIG. 11 is a simplified diagram of an optical mount with external fiducials according to an embodiment of the present invention. Referring to FIG. 11, an example of an optical mount is provided including the origin defined at the top left corner of the area for receiving the optical element, which has a width and a length. Two fiducial locations Fid3 and Fid4 are illustrated at coordinates $(x_3, y_3)$ and $(x_4, y_4)$, respectively. The origin location, axis coordinate system, and fiducials can be established with respect to the MRF system using the high magnification camera system.

The mount/optical element is positioned in the MRF tool using a high resolution camera system (1012). Typically, the MRF tools have several degrees of freedom including in x, y and z, rotational, and tilting motions. Thus, an optical mount with external fiducials can be aligned to the MRF Tool using the camera system illustrated in FIG. 3 and the fiducials can be visited by the tool during the alignment process.

A mathematical representation of the optical element and the fiducial locations for the MRF tool are developed in order to associate the MRF and the optical element coordinate system. This step can also be referred to as generating mathematical fiducials and system dimensions (1014). Using this step, the optical element and the MRF coordinate system are associated in a mathematical model. The mathematical fiducials are then registered to the MRF tool and the optical coordinate system (1016).

Figure 12A:
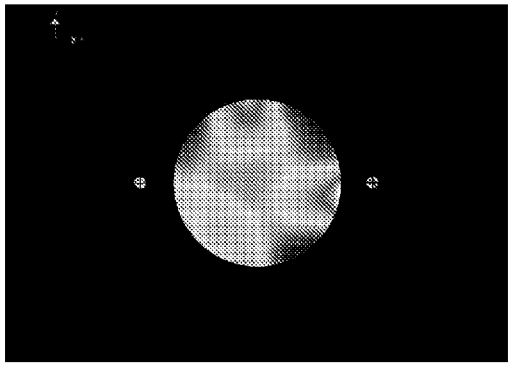
FIGS. 12A-12F are interferograms measured or computed at various stages of the process for associating and aligning the optical element to the MRF system.

A first metrology map of the optical element mounted in the mount with external fiducials in the field of view is obtained (418). The external fiducials are in the field of view when the first metrology map is obtained. As described more fully below, the first metrology map with the external fiducials is used to reference the position of the external fiducials 212 to various physical features, e.g., non-uniformities, present on the surface or inside the optical element to be polished. An example of a first metrology map including the external fiducials is an interferogram showing the optical element and the external fiducials as illustrated by FIG. 12A. Referring to FIG. 7A, cross-hairs are visible at two locations not overlapping the optical element, but to the sides of the optical element. Variations in the surface profile of the optical element and/or internal variations are illustrated by the color differences in FIG. 12A.

Figure 12D:
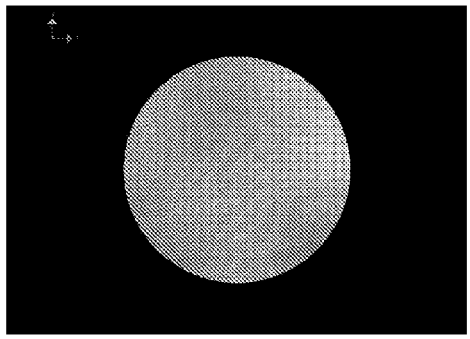
Figure 12B:
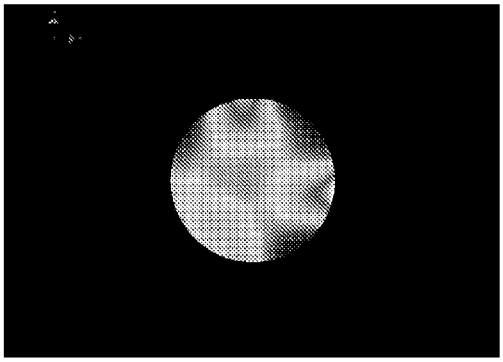

The method 1000 also includes obtaining a second metrology map of the optical element with the external fiducials outside the field of view (1020). The second metrology map only includes information on the optical element and whatever non-uniformities are present on the surface or inside the optical element. In an embodiment, the second metrology map is a phase map, e.g., an interferogram of the transmitted wavefront for the particular optical element that is measured as illustrated in FIG. 12B. The field of view is selected to exclude the external fiducials during the collection of the second metrology map.

Figure 12E:
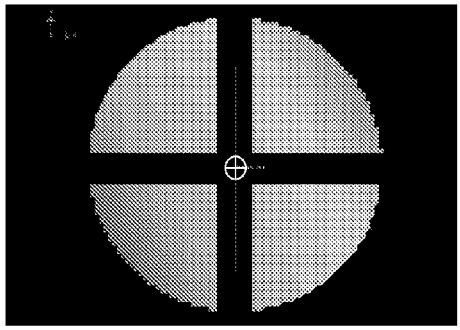
Figure 12C:
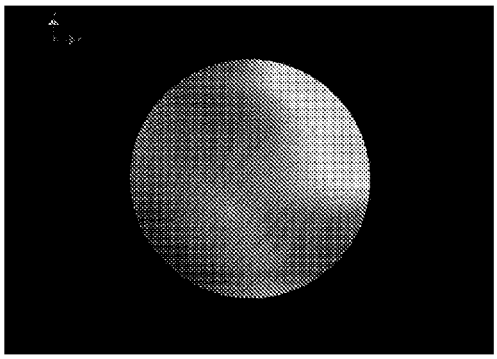

The method 1000 further includes forming a difference map for the first metrology map and the second metrology map (1022). In an embodiment, software developed for the MRF system is utilized to form the difference map. Referring to FIG. 12C, an unoptimized difference interferogram is illustrated as an example of the difference map. As illustrated in FIG. 12C, the external fiducials are not present in the interferogram, but a linear variation oriented at an angle of approximately 45 degrees to a horizontal line is present. In a manner similar to the interferogram illustrated in FIG. 7C, the origin of this linear variation is due to wedge or tip/tilt error resulting from the metrology process.

The first metrology map and the second metrology map are aligned (1024). In some embodiments, affine transformations are used to align the first metrology map and the second metrology map. This step associates the fiducial locations between the two metrology maps. FIG. 12D illustrates a difference interferogram of the optical element that is optimized in three dimensions (x, y, and z) using affine transformations to minimize the variance.

Figure 12F:
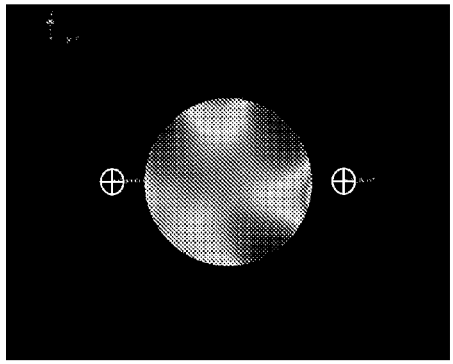

Mathematical fiducials are placed onto the second metrology map to form a third metrology map (1026). The mathematical fiducials are placed on the second metrology map using the difference map formed in step 1022 in an embodiment. Referring to FIG. 12E, the placement of one of the mathematical fiducials on the second metrology map is illustrated. As will be evident to one of skill in the art, multiple mathematical fiducials can be placed on the second metrology map. In some embodiments, the placement of the mathematical fiducials can be performed with sub-pixel accuracy. The third metrology map (the metrology map with the external fiducials outside the field of view and the mathematical fiducials added) is now associated with the optical element to be polished and the MRF coordinate system so that the MRF system can be used to polish the optical element. An example of a third metrology map is illustrated in FIG. 12F, which is the interferogram without the external fiducials plus the mathematical fiducials. The result of the process described herein is to associate and accurately align the optical element coordinate system with the MRF system and interferometry coordinate systems. Referring to FIGS. 11 and 12F, Fid3 is aligned with the mathematical fiducial to the left of the interferogram and Fid4 is aligned with the mathematical fiducial to the right of the interferogram. In this manner, FIG. 11 illustrates association of the MRF system and the optical element coordinate system and FIG. 12F illustrates association of the metrology (interferometry) system and the optical element coordinate system.

The origin of the mount including the optical element is located using the high resolution camera system (1028). The mount including the optical element is placed onto the MRF tool and the optical element is polished (1030).

Thus, using the methods and systems described herein, the MRF tool is able to accurately register the removal function to the metrology map of the optical element and the corresponding non-uniformities. Once the MRF tool is registered to the optical element in this manner, the optical element is polished to form predetermined features on the surface of the optical element.

It should be appreciated that the specific steps illustrated in FIG. 10 provide a particular method of polishing an optical element according to an embodiment of the present invention. Other sequences of steps may also be performed according to alternative embodiments. For example, alternative embodiments of the present invention may perform the steps outlined above in a different order. Moreover, the individual steps illustrated in FIG. 10 may include multiple sub-steps that may be performed in various sequences as appropriate to the individual step. Furthermore, additional steps may be added or removed depending on the particular applications. One of ordinary skill in the art would recognize many variations, modifications, and alternatives.

In an alternative embodiment applicable to some geometries of optical elements, for example, rectangular optical elements, the edge of the optical element is used as a landmark. In these embodiments, modification of the methods discussed in relation to FIG. 4 and FIG. 10 is provided in order to use the edges of the optical element as a landmark. As an example, a corner of the optical element could be defined as an origin, aligned to the MRF tool and polished accordingly.

It is also understood that the examples and embodiments described herein are for illustrative purposes only and that various modifications or changes in light thereof will be suggested to persons skilled in the art and are to be included within the spirit and purview of this application and scope of the appended claims.

What is claimed is:

1. A method of finishing an optical element, the method comprising:

mounting the optical element in an optical mount having a plurality of fiducials overlapping with the optical element;

obtaining a first metrology map for the optical element and the plurality of fiducials;

obtaining a second metrology map for the optical element without the plurality of fiducials;

forming a difference map between the first metrology map and the second metrology map;

aligning the first metrology map and the second metrology map;

placing mathematical fiducials onto the second metrology map using the difference map to form a third metrology map;

associating the third metrology map to the optical element;

mounting the optical element in a fixture in an MRF tool;

positioning the optical element in the fixture;

removing the plurality of fiducials; and finishing the optical element.

2. The method of claim 1 wherein the plurality of fiducials comprise a wire grid oriented substantially parallel to a surface of the optical element.

3. The method of claim 1 wherein the first metrology map includes artifacts associated with the fiducials.

4. The method of claim 1 wherein the optical element comprises at least one of a Ti:sapphire or sapphire crystal.

5. The method of claim 1 wherein the MRF tool comprises:

a wheel operable to provide a removal function less than 200 μm in spatial extent; and a camera system with a spatial resolution less than 20 μm.

6. An MRF system for polishing an optical element, the MRF system comprising:

a processor;

an MRF tool coupled to the processor, the MRF tool comprising:

a wheel operable to provide a predetermined removal function;

an optical mount operable to receive the optical element and a plurality of fiducials; and a computer readable medium coupled to the processor and storing a plurality of instructions for controlling the MRF tool to polish the optical element, the plurality of instructions comprising:

instructions that cause the data processor to obtain a first metrology map for the optical element and the plurality of fiducials;

instructions that cause the data processor to obtain a second metrology map for the optical element without the plurality of fiducials;

instructions that cause the data processor to form a difference map between the first metrology map and the second metrology map;

instructions that cause the data processor to align the first metrology map and the second metrology map;

instructions that cause the data processor to place mathematical fiducials onto the second metrology map using the difference map to form a third metrology map;

instructions that cause the data processor to associate the third metrology map to the optical element; and instructions that cause the data processor to control the MRF tool to finish the optical element.

7. The MRF system of claim 6 wherein the plurality of fiducials comprise a wire grid oriented substantially parallel to a surface of the optical element.

8. The MRF system of claim 6 wherein the first metrology map includes artifacts associated with the fiducials.

9. The MRF system of claim 6 wherein the optical element comprises at least one of a Ti:sapphire or sapphire crystal.

10. The MRF system of claim 6 wherein the MRF tool comprises:

a wheel operable to provide a removal function less than 200 μm in spatial extent; and a camera system with a maximum spatial resolution less than 20 μm.

11. A method for polishing an optical element, the method comprising:

mounting the optical element in an optical mount having an area operable to receive the optical element and a plurality of fiducials positioned adjacent to the area;

obtaining a first metrology map including the optical element and the plurality of fiducials;

obtaining a second metrology map including the optical element, the second metrology map being free of the plurality of fiducials;

forming a difference metrology map based on the first metrology map and the second metrology map;

aligning the first metrology map to the second metrology map;

adding mathematical fiducials to the second metrology map to form a third metrology map;

positioning the optical mount in an MRF tool;

registering the optical mount to the MRF tool using the third metrology map; and polishing the optical element.

12. The method of claim 11 wherein the plurality of fiducials comprise a plurality of patterns disposed in a plane substantially parallel to a surface of the optical element.

13. The method of claim 11 wherein the optical element comprises at least one of a Ti:sapphire or sapphire crystal.

14. The method of claim 11 wherein the MRF tool comprises:

a wheel operable to provide a removal function less than 200 μm in spatial extent; and a camera system with a spatial resolution less than 20 μm.

15. An MRF system for polishing an optical element, the MRF system comprising:

a processor;

an optical imaging system;

an MRF tool coupled to the processor, the MRF tool comprising:

a wheel operable to provide a predetermined removal function;

an optical mount operable to receive the optical element and including a plurality of external fiducials; and a computer readable medium coupled to the processor and storing a plurality of instructions for controlling the MRF tool to polish the optical element, the plurality of instructions comprising:

instructions that cause the data processor to mounting the optical element in an optical mount having an area operable to receive the optical element and a plurality of fiducials positioned adjacent to the area;

instructions that cause the data processor to obtain a first metrology map including the optical element and the plurality of fiducials;

instructions that cause the data processor to obtain a second metrology map including the optical element, the second metrology map being free of the plurality of fiducials;

instructions that cause the data processor to form a difference metrology map based on the first metrology map and the second metrology map;

instructions that cause the data processor to align the first metrology map to the second metrology map;

instructions that cause the data processor to add mathematical fiducials to the second metrology map to form a third metrology map; and instructions that cause the data processor to control the MRF tool to polish the optical element.

16. The method of claim 15 wherein the plurality of fiducials comprise a plurality of patterns disposed in a plane substantially parallel to a surface of the optical element.

17. The method of claim 15 wherein the optical element comprises at least one of a Ti:sapphire or sapphire crystal.

18. The method of claim 15 wherein the MRF tool wherein the predetermined removal function is less than 200 μm in spatial extent and the optical imaging system is characterized by a spatial resolution less than 20 μm.

* * * * *